US006314779B1

(12) United States Patent
Kesinger

(10) Patent No.: US 6,314,779 B1
(45) Date of Patent: Nov. 13, 2001

(54) CONDUCTOR REDUCER FOR CO-AXIAL CABLE

(76) Inventor: Donald A. Kesinger, 8206 S. Deercreek Canyon, Morrison, CO (US) 80465

( * ) Notice: Subject to any disclaimer, the term of this patent is extended or adjusted under 35 U.S.C. 154(b) by 0 days.

(21) Appl. No.: 09/569,516

(22) Filed: May 12, 2000

Related U.S. Application Data

(60) Provisional application No. 60/134,928, filed on May 19, 1999.

(51) Int. Cl.[7] ..... B21D 41/04
(52) U.S. Cl. ..... 72/125; 72/126
(58) Field of Search ..... 72/78, 125, 126

(56) References Cited

U.S. PATENT DOCUMENTS

| | | | | |
|---|---|---|---|---|
| 599,266 | | 2/1898 | Smith . | |
| 602,940 | | 4/1898 | Hall . | |
| 1,098,408 | | 6/1914 | Rorive . | |
| 1,778,487 | | 10/1930 | Earnest . | |
| 2,682,848 | | 7/1954 | Kreutzer . | |
| 3,815,397 | * | 6/1974 | Hollencamp | 72/126 |
| 3,940,963 | | 3/1976 | Borodin . | |
| 4,002,048 | | 1/1977 | Pozsgay . | |
| 4,033,163 | * | 7/1977 | Duffey et al. | 72/126 |
| 4,106,352 | | 8/1978 | Arndt . | |
| 5,857,371 | | 1/1999 | Bindernagel . | |
| 5,927,128 | | 7/1999 | Pithan . | |

* cited by examiner

*Primary Examiner*—Lowell A. Larson
(74) *Attorney, Agent, or Firm*—Thomas W. Hanson

(57) ABSTRACT

A tool for reducing the diameter of the center conductor of a coaxial cable allowing it to mate with a smaller receptacle without the necessity of a reducer. The tool uses plural rollers within a housing to roll form the conductor as they rotate about it. Preferably the rollers are caged for alignment but bear on the inner surface of the housing. The housing thus resists the axial loads on the rollers and transmits the rotational drive force directly to the rollers allowing the roller cage to serve solely alignment purposes. The roller cage incorporates an extended nose designed to contact the dielectric portion of the cable, serving as a depth stop. An optional indicator sleeve is visible through openings in the housing and indicates the position of the roller cage within the housing. A small lead angle on the rollers causes them to self feed onto the conductor and to crawl rearward within the chamber which provide the indication of the length of conductor reduced. The rollers may have any of various profiles and may impart a matching profile on the conductor. Alternate forms of the rollers use independently rotating body and nose portions to avoid creating a twist in the reduced conductor. An optional stop collar may be fitted to the extended nose of the roller cage to contact the cable outer conductor, providing more precise indexing.

22 Claims, 12 Drawing Sheets

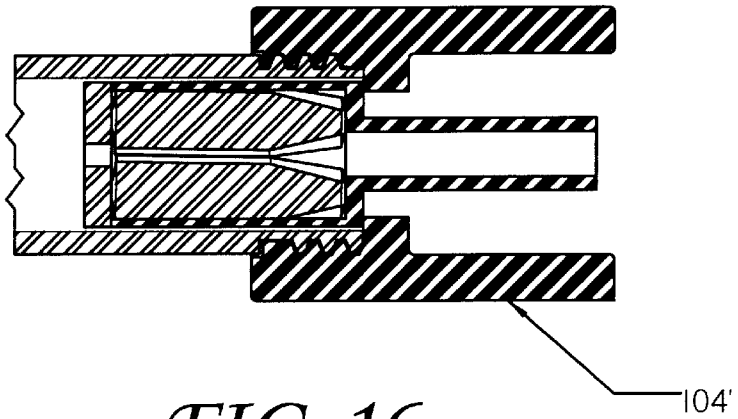
FIG. 16
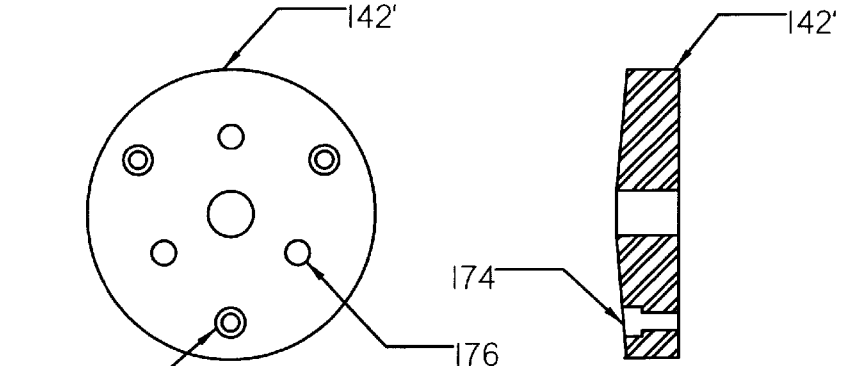
FIG. 18
FIG. 19
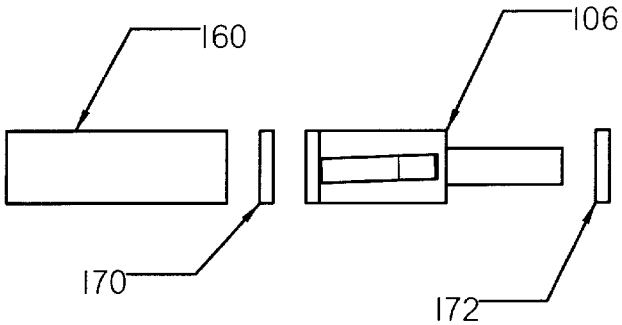
FIG. 17

CONDUCTOR REDUCER FOR CO-AXIAL CABLE

CROSS-REFERENCE TO RELATED APPLICATIONS

This application claims the benefit of U.S. Provisional Application No. 60/134,928 filed May 19, 1999.

FIELD OF THE INVENTION

This invention relates to devices for reducing the diameter of only a portion of a conductor allowing it to mate with a smaller diameter receptacle. More specifically it relates to such devices which use roll forming to effect the reduction.

BACKGROUND OF THE INVENTION

The cable television industry is not a unified one. It has evolved from a large number of independent providers and a larger number of vendors who supply them with equipment. This has resulted in the use of a large number of equipment and cable standards throughout the industry. The situation is further complicated by the range of environments in which transmission cables and equipment must operate. The requirements for a central office to distribution hub connection, for example, are significantly different than those for the connection from the street to a subscribers house. Other industries reflect a similar growth and exhibit their own version of the following problems.

One direct consequence of this environment is the range of coaxial cable sizes in use and the range of receptacle sizes in use on the equipment to which the cables connect. Common sizes for center conductors range from 0.023" through 0.25". Outer conductors exhibit a similar range. Where a cable of a certain size is to be connected to an equipment receptacle of the same size, a simple pass through connector can be used. This type of connector grips the outer conductor and possibly the insulation of the cable and then threads into (or connect in some other manner) the receptacle, providing a physical connection as well as the electrical connection for the outer conductor. The center conductor extends through the connector and mates with a corresponding contact on the equipment receptacle. When the connector is separated from the equipment receptacle, the center conductor of the cable typically passes completely through the connector and protrudes beyond it, giving rise to the name "pass through" connector.

It is frequently necessary to connect a cable to a piece of equipment where the conductor size and the receptacle size is mismatched. A common situation for this is where cable designed for a long exterior run, such as a distribution cable from a central office, is routed into a building and connected to equipment designed for interior use and for connection to local cable runs. The presents the common problem of connecting a cable with a larger center conductor to a receptacle designed to receive a smaller conductor. The prior art approach to solving this problem is to use a reducing, or "pin type", connector similar to that pictured in FIG. 12. The connector, 230, is a multi-part assembly which attaches to the cable and connects the center conductor to a pin, 236, which is then used to connect to the equipment. A typical example of such a connector requires 14 separate parts and 4 o-rings to make the connection. Several of these parts are necessitated solely by the need to retain and position the pin. The connector also introduces an additional connection at the conductor to pin interface. Each connection can be a source of problems including RF noise, and unnecessary connections are undesirable. In addition, several impedance changes occur within the connector as the relative diameters of the center conductor (or pin) and the connector cavity change.

Impedance is a critical measurement of the effective resistance a coaxial connection and is directly related to the ratio of the outer diameter (OD) of the center conductor and the inner diameter (ID) of the enclosing outer conductor or connector housing, as is well known in the art. Changes in impedance along the path through a connector cause RF noise and signal degradation. To reduce impedance changes, changes in the conductor OD (such as at the connector to pin connection) should be matched with a change in the ID of connector and there should be no changes in connector ID not matched by connector OD changes. (This is a slight simplification because changes in the dielectric material within the gap between the center and outer conductors also impacts the impedance.) As can be seen in FIG. 12, there are several points where there is a mismatched change in one of the diameters leading to a degradation in the signal.

The reduction connector is significantly more complex and more expensive than the pass through connector. The price difference, even where purchased in large quantities is estimated at $1.00 per connector. Given the hundreds of thousands, or even millions, of connectors required by a cable company, this is a significant expense. In addition, a company needs to maintain an inventory of all of the various connector sizes required to address all of the possible size changes encountered throughout its system.

There is a need for a tool which reduces the diameter of the center conductor of a coaxial cable to the size necessary to mate directly with a smaller size receptacle, allowing a pass through connector to be used in place of a reducing connector. Because of the various combinations of connector and cable sizes encountered, the tool should be able to reduce a range of original center conductor sizes to the same reduced size. The tool should be readily adapted to produce different reduced sizes. The tool should be easy to use and be usable in typical field conditions encountered by those in the cable television and other communications industries. The tool should provide precise control over the profile of the reduction in the conductor and over the placement of that profile relative to some point on the cable, such as the end of the outer conductor, to allow precise alignment of the reduction profile with matching profiles in the connector.

SUMMARY OF THE INVENTION

The present invention is directed to an apparatus for reducing the diameter of the center conductor of a coaxial cable by rotary forming.

According to a first embodiment of the invention there is provided a roller cage with a central passage therethrough, aligned with the rotational axis, and having a plurality of chambers distributed around the rotational axis and opening onto the central passage. Rollers are fitted to each of the chambers so that they extend into the central passage. A connection is provided to connect the roller cage to an external portable rotary drive source such as an electric drill. The rollers may be mounted at a lead angle.

According to a second embodiment of the invention there is provided a roller cage, plural rollers with a tapered noses mounted in the cage, a housing with an internal chamber to receive the cage and rollers, a mechanism to retain the rollers and cage within the chamber, a spring or other mechanism to push the cage toward the open end of the chamber, and a connection to an external rotary drive source. The rollers may be mounted at a lead angle.

According to an aspect of the invention the rollers include a continuous curve transition between the body of the roller and the nose of the roller. This curve is transferred to the conductor as it is reduced resulting in a smooth transition in diameters.

According to another aspect of the invention the roller may be shaped in a manner that keeps the body of the roller from contacting the reduced portion of the conductor during the forming process. Alternatively, the body and nose of the roller may rotate independently but about a common axis.

Further in accordance with the invention there is provided a depth stop attached to the roller cage which impinges on either the dielectric or outer conductor of the coaxial cable. The depth stop is free to rotate independently of the roller cage.

Still further in accordance with the invention the cage may be driven directly by the housing and the cage then drive the rollers or the rollers may extend through the cage and contact the inner wall of the housing and be driven directly by that contact. In either approach, the cage is free to move longitudinally in the chamber, although resisted by the spring or other mechanism.

Yet still further in accordance with the invention there may be provided a visual depth indicator preferably made up of a sleeve which follows the movement of the roller cage and one or more openings in the housing through which the indicator sleeve can be viewed during operation of the tool.

The advantages of such an apparatus are that it provides a means of quickly and easily forming a reduced diameter segment on the center conductor of a coaxial cable to allow it to mate with a smaller receptacle. This allows the use of a simpler and less expensive pass through connector to make a physical connection. A set of rollers and roller cage (a cartridge) will form a range of conductors to the same reduced size. The cartridge can be interchanged to form different reduced sizes. The tool is relatively small and easily portable and can be driven by tools readily available in a typical field environment such as electric or pneumatic drills. The design of the rollers and their indexing relative to a depth stop which contacts the cable allows the placement of the reduction profile, where the original diameter portion tapers to the reduced diameter, to be precisely controlled. This enables the use of connectors with internal profiles matched to the conductor profile to significantly reduce or eliminate signal noise generated by changes in impedance in the connector.

The above and other features and advantages of the present invention will become more clear from the detailed description of a specific illustrative embodiment thereof, presented below in conjunction with the accompanying drawings.

BRIEF DESCRIPTION OF THE DRAWINGS

FIG. 16 is a cross section illustrating an alternative cap which incorporates a guard.

FIG. 17 illustrates the placement of optional bushings at the front and rear of the roller cage.

FIG. 18 is a top view of an alternative form of the roller cage rear plate incorporating shaft sockets and a crown.

FIG. 19 is a cross section of the alternative form of the roller cage rear plate incorporating shaft sockets and a crown.

DETAILED DESCRIPTION OF THE INVENTION

The following discussion focuses on the preferred embodiment of the invention, which reduces the diameter of the center conductor of coaxial cable typically used in the cable television industry. However, as will be recognized by those skilled in the art, the disclosed apparatus is applicable to a wide variety of situations in which it is desired to reduce the diameter of a malleable rod or conductor.

Glossary

The following is a brief glossary of terms used herein. The supplied definitions are applicable throughout this specification and the claims unless the term is clearly used in another manner.

Cap—threaded element which attaches to the end of the housing to act as a retaining mechanism holding the roller cage within the housing.

Cartridge—the replaceable unit consisting of the roller cage and rollers.

Forward, rearward—forward is in the direction toward the nose of the tool where the conductor is inserted; rearward is in the direction of the drive shaft.

Housing—generally cylindrical structure which encloses the spring and roller cage and to which the cap attaches.

RF—radio frequency.

Roller—element which contacts and forms the conductor. In the preferred embodiment it is generally cylindrical with a tapered nose, and a slight taper toward the rear.

Roller cage—structure which enclosed the rollers

Stop collar—optional sleeve, or collar, which fits over the neck of the roller cage.
It acts as a depth limiter by contacting the outer conductor of the cable.

Preferred Embodiment

Overview

The disclosed invention is described below with reference to the accompanying figures in which like reference numbers designate like parts. Generally, numbers in the 200's refer to prior art elements or elements in the surrounding environment while numbers in the 100's refer to elements of the invention.

Figure 1:
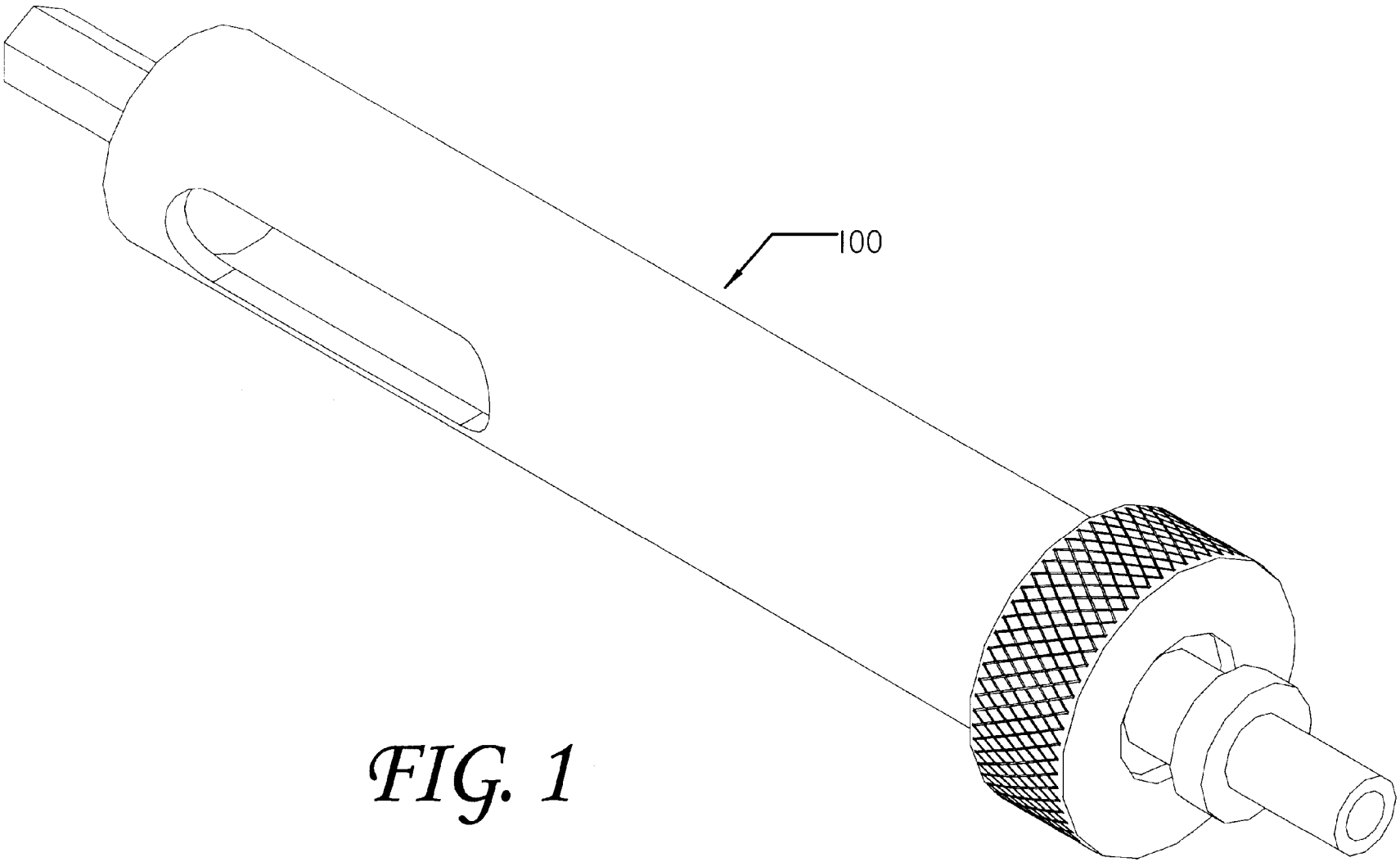
FIG. 1 provides an isometric view of the tool.

The present invention is a tool, 100 in FIG. 1, to reduce the diameter of the end of the center conductor in a coaxial cable. This process essentially forms an integral pin on the end of the conductor, obviating the need for a size reducing adapter. This allows a cable with a relatively larger conductor to be connected directly to a receptacle of a reduced size. The preferred embodiment is optimized for use in the cable television industry where such size differences are common at hubs, central offices, and other distribution points as well as at the drop box where the line run to a house is connected to the distribution line at the street. However, the present invention is applicable to variety of industries including computer and military applications where conductor size reduction is desired.

Figure 12:
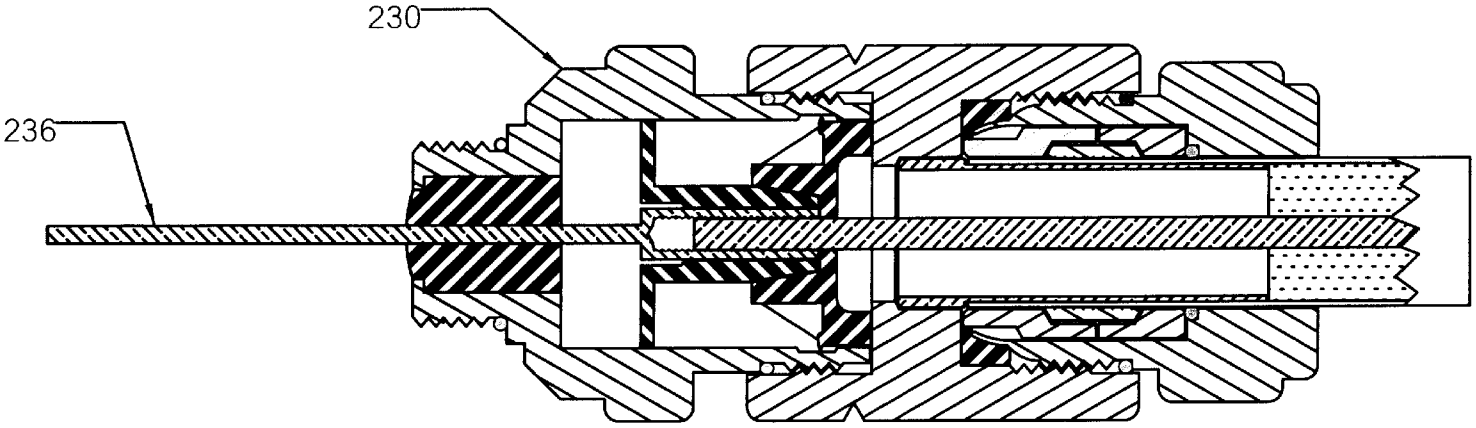
Prior Art FIG. 12
FIG. 12 illustrates a typical prior art reducing connector.
Figure 13:
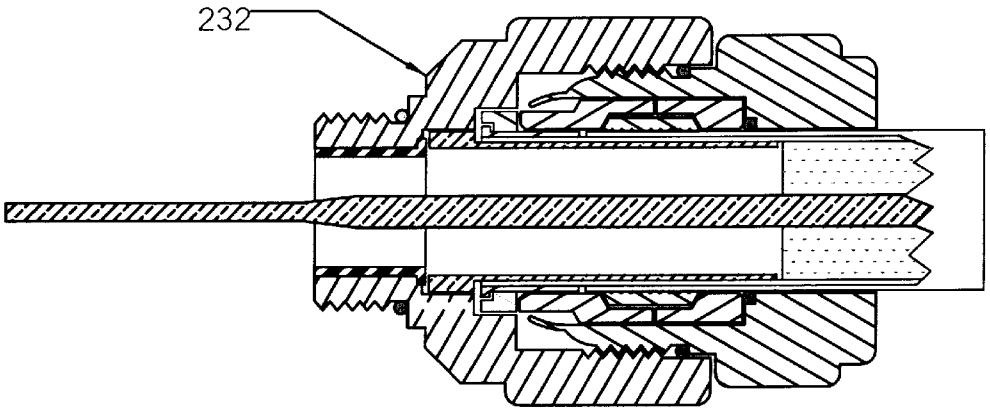
FIG. 13 illustrates a pass through connector attached to a reduced cable.

The creation of a reduced diameter integral pin allows a simple pass through connector, see FIG. 13, to be used in place of a conventional size reducing connector, see FIG. 12, with a captive pin. The pass through connector is smaller, simpler, contains significantly fewer parts and is less expensive than the size reducing connector. Further, its use reduces the number of connections by eliminating the separate pin and reduces the number of inner diameter transitions in the connector enabling fewer impedance changes and better impedance matching and improved overall RF noise characteristics. The reducing process also leaves the copper cladding on the conductor uninterrupted retaining its characteristics. Because the tool is capable of forming integral pins of a variety of diameters (such as 0.067" or 0.078") and can work with a range of conductor diameters (such as 0.109", 0.125" and 0.137") a wide number of combinations of original and reduced diameters can be accomplished. Since the pass through connector is independent of the center conductor diameter, the same connector can be used with multiple conductor sizes. This significantly reduces the number of distinct parts which a company would be required to maintain on hand to handle the various required connections. Note that the various different reduced sizes are achieved by interchanging a cartridge as described below and that a single cartridge is capable of handling a continuous range of original conductor sizes between a minimum and maximum which is dependent on the design of a particular set of rollers.

Structure

Figure 2:
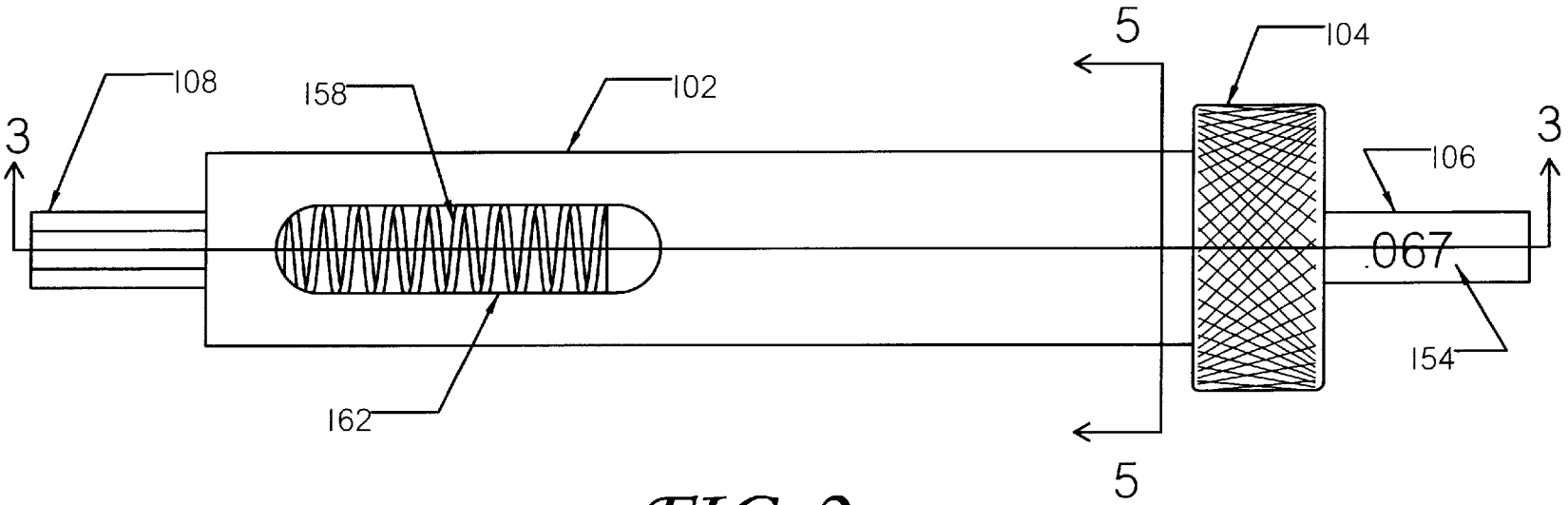
FIG. 2 provides a side view of the tool.
Figure 3:
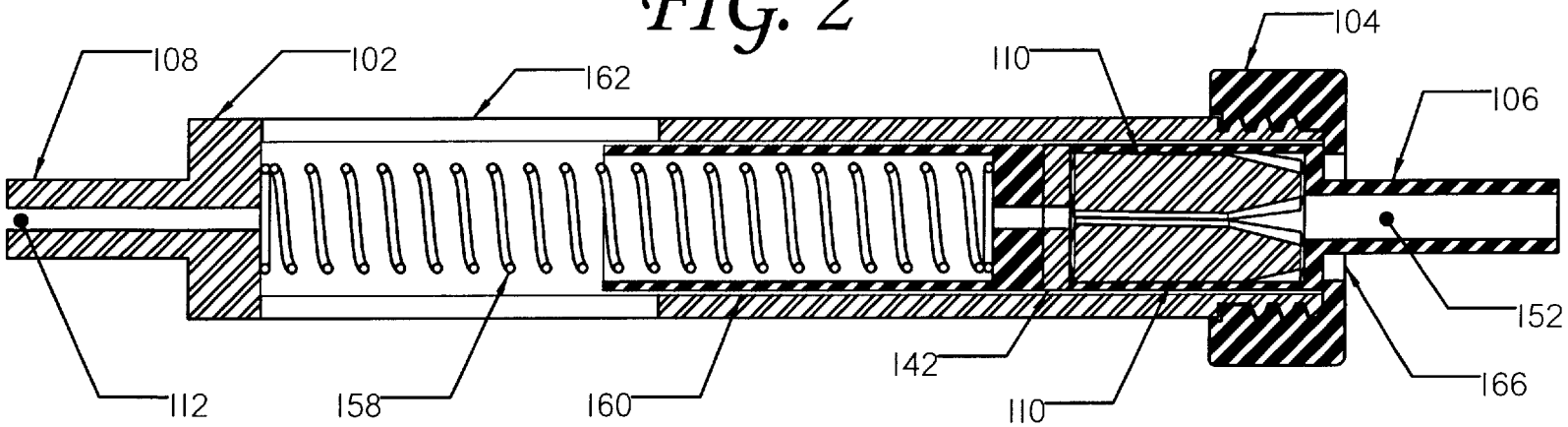
FIG. 3 provides a cross section through the tool showing the configuration of the internal elements.
Figure 4:
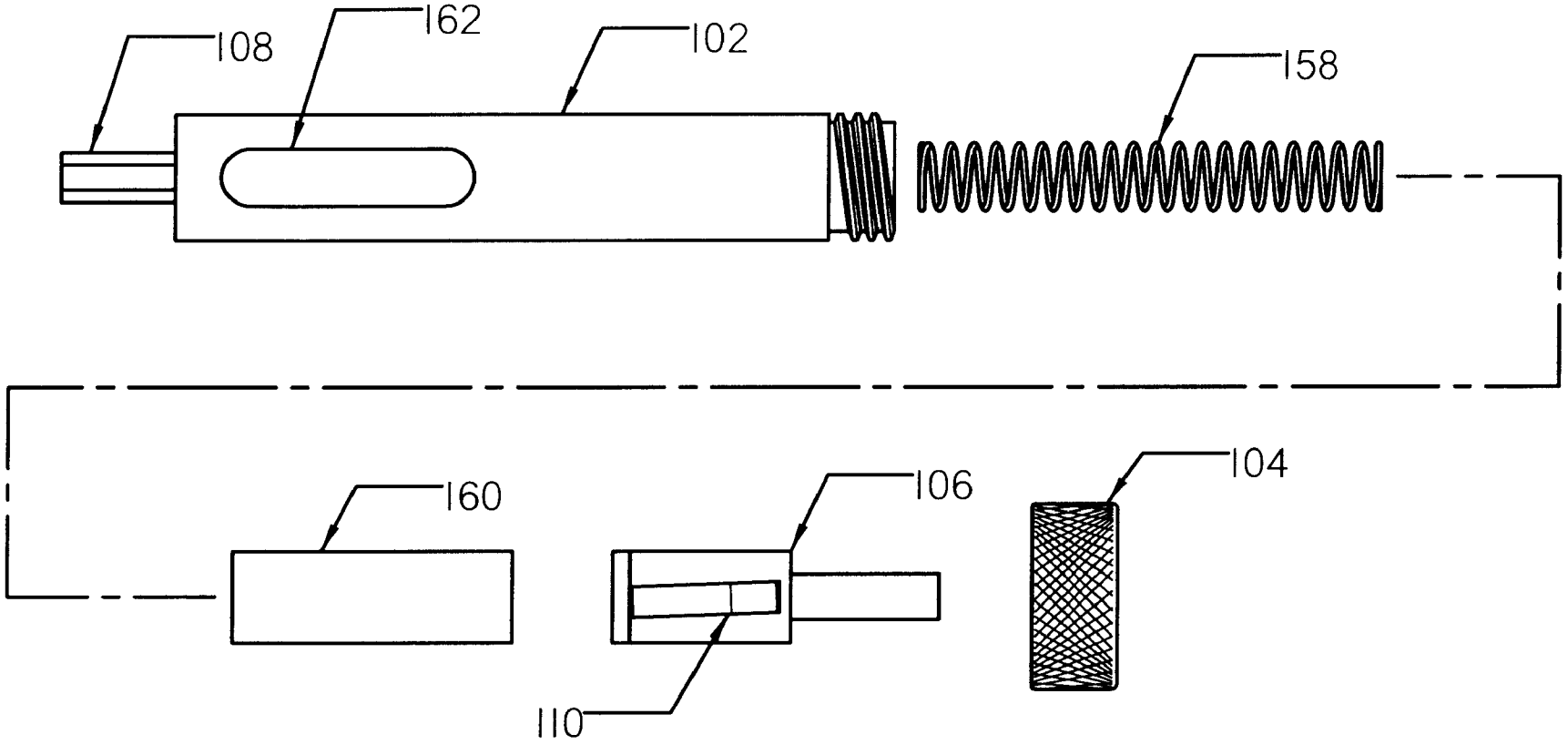
FIG. 4 is an exploded view of the tool.
Figure 5:
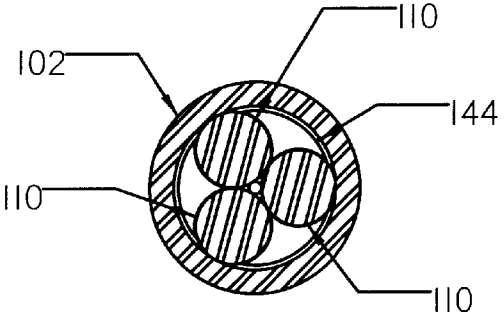
FIG. 5 is a cross section through the housing, roller cage, and rollers.

The structure and components of the preferred embodiment of the invention can be clearly seen with reference to FIGS. 2–4. The housing, 102, is the primary structural element of the invention, enclosing and supporting the majority of the other elements. It also mounts the cap, 104, to retain the other elements within the housing. In the preferred embodiment the housing is cylindrical with a smoother outer surface and a smooth walled cylindrical inner chamber. The circular cross section of the inner chamber is important to functioning of the invention because the chamber walls serve as a bearing surface upon which the rollers ride. The inner diameter (I.D.) of the chamber closely approximates the outer diameter (O.D.) of the set of rollers as they are positioned within the roller cage. The chamber I.D., in combination with the outer diameter of the individual rollers, determines the resulting reduced conductor diameter formed by the tool. The smooth circular shape of the outer surface is not functionally important to the invention but improves the usability and safety of the device by preventing impacts or snags as the device rotates while in use.

The drive shaft, 108, is a hexagonal shape adapted to be gripped by the chuck of an electric drill, or similar driving device, which provides the rotational force necessary to use the tool. In the preferred embodiment, the drive shaft is formed integrally with the housing, 102. Clearly it could be a separate piece connected to the housing by any of various conventional means including welding, bonding, pinning, or threading. The shaft could also be of different shape appropriate to making a connection to another type of driving device. Threaded connections; Jacobs, or other, tapers; splines; and keys are clearly applicable, as are other known types of connections. In a more general form, all that is required is a drive connection of any form. A contoured recess, such as a square, hex or splined socket formed in the housing, which would mate with a matching drive shaft on the power source, would work equally well. Where the housing is of sufficiently small diameter, such as for a version designed for use with very small diameter cables, the housing could be gripped directly by the drill chuck. In the preferred embodiment, the drive shaft and the end of the housing are formed with a passage, 112, aligned with the axis of rotation through which the reformed conductor can extend. Where the relative length of the housing chamber is sufficient to contain the reduced portion of the conductor, this passage can be eliminated.

The rollers, 110, are the elements of the invention which actually form the conductor to reduce its size. They do so by rotating axially about the conductor as it is fed between them. The rollers taper so that the gap defined between them varies. At the outer end, this gap is sufficiently large to accept the unmodified conductor. At the point of maximum roller diameter, the defined gap is equal to the desired diameter to which the conductor will be reduced. The radius of this gap is calculated by subtracting the diameter of a roller (all should be the same) from the radius of the inner surface of the chamber. The rollers are enclosed and aligned by the roller cage as described below. In use, the rollers are forced outward by the conductor and bear against inner surface of housing. This contact with both the stationary conductor and the rotating housing causes the rollers to each rotate about their own longitudinal axis. The contact with the inner surface of the housing also transmits the rotary driving force to the rollers. The action of the rollers is to roll about the conductor, applying a balanced, radially inward force to the conductor. This force compresses the conductor, maintains (or even creates) a precise circular cross section, and keeps the conductor centered between the rollers. This process is self aligning in that the longitudinal axis of the conductor is maintained in alignment with the axis of rotation of the tool. As the conductor compresses, it reduces in diameter and elongates, passing between the rollers. The roller cage, indicator sleeve, spring, and the housing itself, each provide a central passage through which the reformed conductor can extend if necessary.

In the preferred embodiment, the rollers are mounted in the roller cage with a lead angle preferably in the range of 1–2 degrees. Lead angle of perhaps ½ to 5 degrees may be appropriate depending on conductor material and diameter, drive force available, and forming rate desired. This lead angle is the angle of the rotational axis of the rollers relative to the rotational axis of the roller cage (and the housing) in a plane tangential to the circular path described by the rotational axis of the rollers as they move about the rotational axis of the cage. Because the rotational axis of the cage is aligned with the longitudinal axis of the conductor, this lead angle results in the rollers contacting the conductor at a slight angle such that the rollers thus travel in a helical path around the conductor and forward. This results in the process being self feeding as the conductor is drawn into the rollers at a fixed rate. The lead angle regulates the feed rate which in turn determines the number of passes the rollers make over a particular point on the conductor in order to reduce the diameter. Larger angles provide faster forming but cause greater radial forces, greater deformation of the conductor material, and increased torque on the conductor possibly twisting it. Smaller angles require less force and provide a better finish but slow the process. An angle of 1½ degrees has been found to provide good performance. Greater or lesser angles could clearly be used as desired. Note that in the preferred embodiment the rear face of the rollers incorporate a slight angle to accommodate the lead angle while bearing on a flat end plate and to reduce the friction of the roller against the end plate.

Figure 10A:
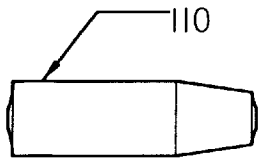
FIGS. 10A–I illustrate alternative forms of the rollers.

Referring to FIG. 10A, the profile of the initial roller design, 110, can be seen. Each roller is elongated with a cylindrical body of constant diameter and a tapered nose which reduces in diameter toward the end. The reduced diameter end is the receiving end of the roller which accepts the conductor. This reduced diameter creates an increased diameter inter-roller gap which is at least slightly larger than the diameter of the unmodified conductor. The diameter of the roller body, in combination with the I.D. of the housing chamber, determines the resulting reduced conductor diameter formed by the tool, as discussed above. Shorter roller designs have been tried as have spherical rollers (such as ball bearings) but were found to not provide good performance.

Figure 15:
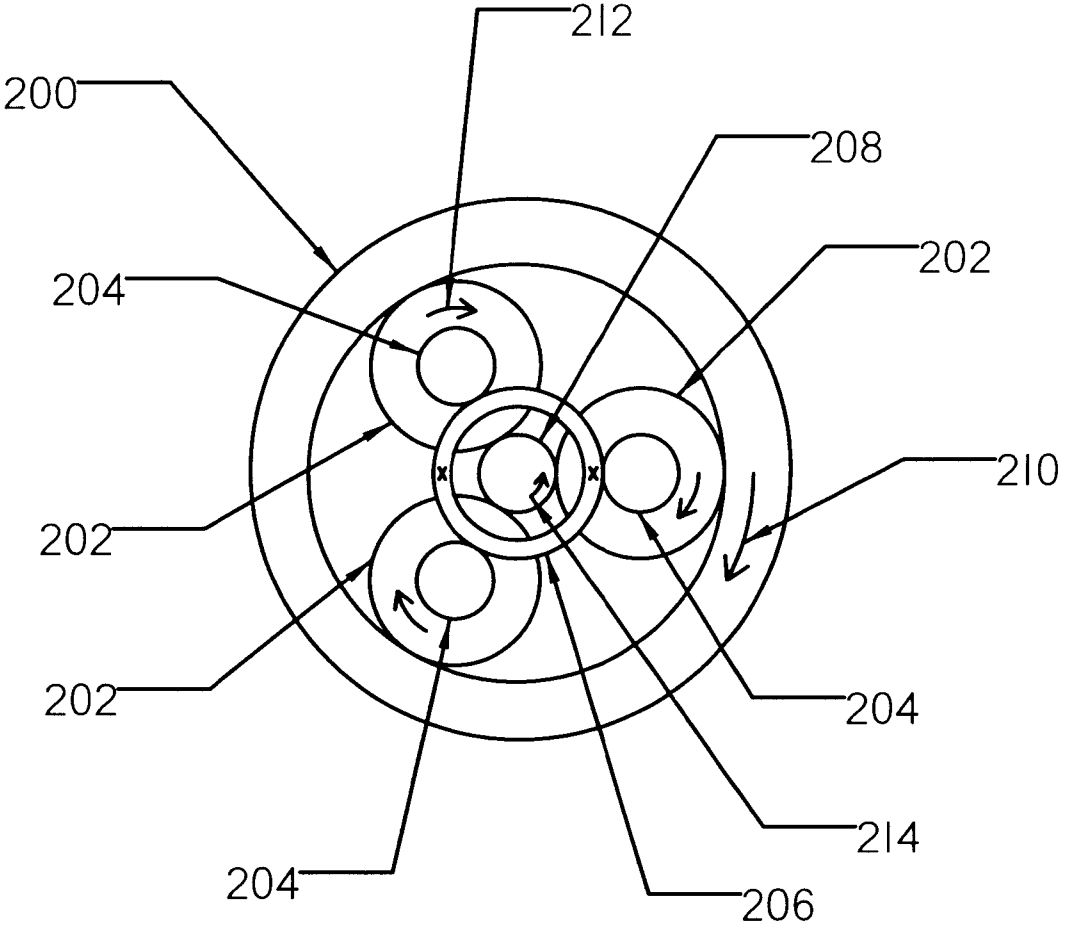
FIG. 15 depicts a planetary drive system analogous to the action of the tool on a conductor, illustrating the creation of a reverse twist.

This initial roller design was found to form a reverse twist in the reduced diameter portion of the conductor. It is reversed in the sense that the conductor is twisted in the direction opposite to the direction the tool rotates. Extensive investigation showed that the cause was the rotational speed of the rollers caused by the point of contact with the conductor. This is most easily explained by analogy to the planetary drive system illustrated in FIG. 15. In that system the outer ring, 200, is driven in the direction shown by the arrow, 210. Ring, 206, is held stationary, as shown by the X's, and is in contact with disks (gears), 204. Disks, 204, and disks, 202, are fixed together so that they rotate at the same rate. With ring 206 held stationary, disks, 202 and 204, rotate in the direction of arrow, 212. Disks, 202, are also in contact with central disk, 208, which is caused to rotate in the direction of arrow, 214, which is opposite the direction of rotation of the outer ring, 200.

In the present invention the outer ring, 200, corresponds to the housing, 102; the disks, 202, correspond to the outer diameter of the body of the rollers, 110, and the smaller disks, 204, correspond to the point on the tapered nose of the roller which initially contacts the full diameter conductor, which corresponds to ring, 206. Research revealed that it was this point of contact which acted as the fixed "sun gear" in the analogous planetary drive system and which determined the rotational speed of the rollers. This is due to the high radial forces resulting from the deformation of the conductor by the rollers at this point. The inner disk, 208, corresponds to the reduced diameter portion of the conductor. Note that it is in contact with the body of the roller which applies a force to rotate it in a direction opposite to the direction of rotation of the tool. This force is what generates the twist in the conductor. While the force is relatively low compared to the force at the nose of the roller, it is applied for the full length of the body and is being applied to the reduced diameter portion of the conductor which is substantially weaker.

Figure 10B:
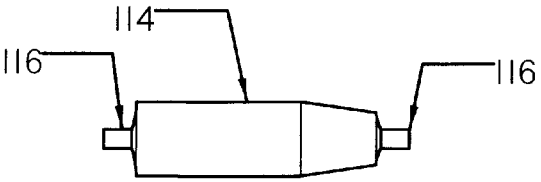

Several alternative forms of rollers have been investigated, some of which address the reverse twist problem. The profile, 114, illustrated in FIG. 10B is the same as the original of 10A with the addition of integral shafts, 116, extending from the ends which are designed to mate with corresponding sockets, bearings, or bushings in the roller cage. This provides improved alignment and stability. Alternatively, a shaft may be used only at the nose of the roller for alignment, with the rear of the roller left plain so that it will be forced out against the wall of the chamber without interference from a shaft. See FIG. 10F.

Figure 10C:
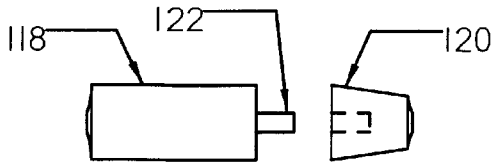
Figure 10D:
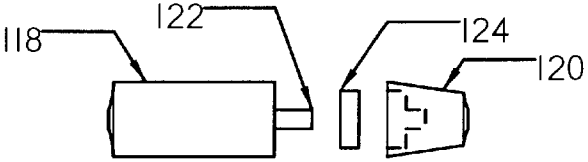
Figure 10E:
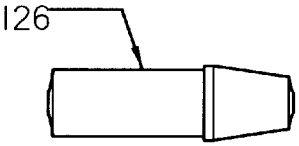
Figure 10F:
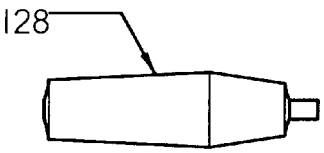
Figure 10G:
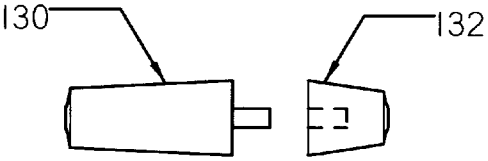

FIGS. 10C and 10D illustrate a two part roller in which the body, 118, and nose, 120, are connected by shaft, 122, but are free to rotate at different speeds. Optional bearing or bushing, 124, serves to reduce friction between the two segments. Either of these designs eliminates the reverse twist problem by allowing the nose and body to rotate at different rates while both are still in contact with the conductor. The designs illustrated in FIGS. 10E and 10F address the reverse twist problem by eliminating the contact between the body of the roller and the reduced diameter portion of the conductor. The design, 126, of FIG. 10E uses a stepped approach where the body diameter is constant but slightly less than the diameter of the widest point of the roller. The FIG. 10F design, 128, uses a tapered body which reduces in diameter toward the end of the roller. Both designs eliminate the friction, and thus the force transfer, between the body of the roller and the reduced portion of the conductor. The design of 10F also incorporates a single shaft at the nose of the roller as discussed above. The design illustrated in FIG. 10G combines the tapered body, 130, of FIG. 10F and the independent nose, 132, of FIG. 10C. All of the designs illustrated by FIGS. 10C through 10G have been found effective in eliminating the reverse twist problem. The design of FIG. 10F is the currently preferred roller embodiment.

An alternative approach to avoiding contact between the roller body and the reduced portion of the conductor is available where the rollers incorporate shafts. Mounting the roller so that the rear of the roller angles slightly away from the rotational axis of the roller cage would achieve the same result as tapering the roller. The body of the roller could then be cylindrical while the taper of the nose, and the profile of the radius (below) might have to be altered to allow for the mounting angle.

Figure 10H:
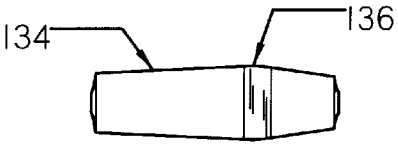

FIG. 10H illustrates a roller, 134, which incorporates a smooth radius transition, 136, from the nose to the body of the roller in combination with a tapered body. The shape of the radius will be mirrored on the conductor providing a carefully controlled curved transition from the tapered portion of the conductor, formed by the nose of the roller, to the reduced diameter portion. The advantage of this will be discussed in detail below. If desired, the radius could be combined with any of the other roller designs.

Figure 10I:
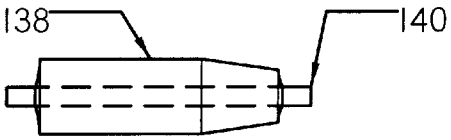

FIG. 10I illustrates the use of a separate through shaft to support the roller. If desired this can be combined with internal bearings or bushings similar to the design of FIG. 10D and any of the roller profiles can be used, including separate body and nose.

Figure 7:
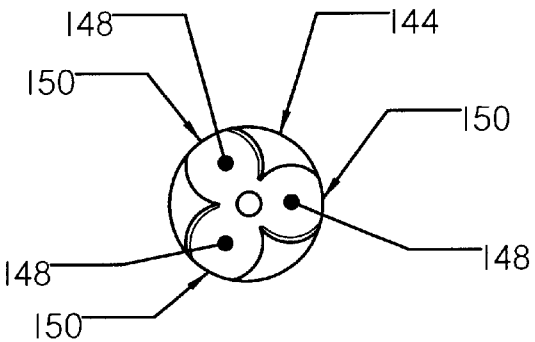
FIG. 7 is an end view of the roller cage showing the roller chambers.
Figure 6:
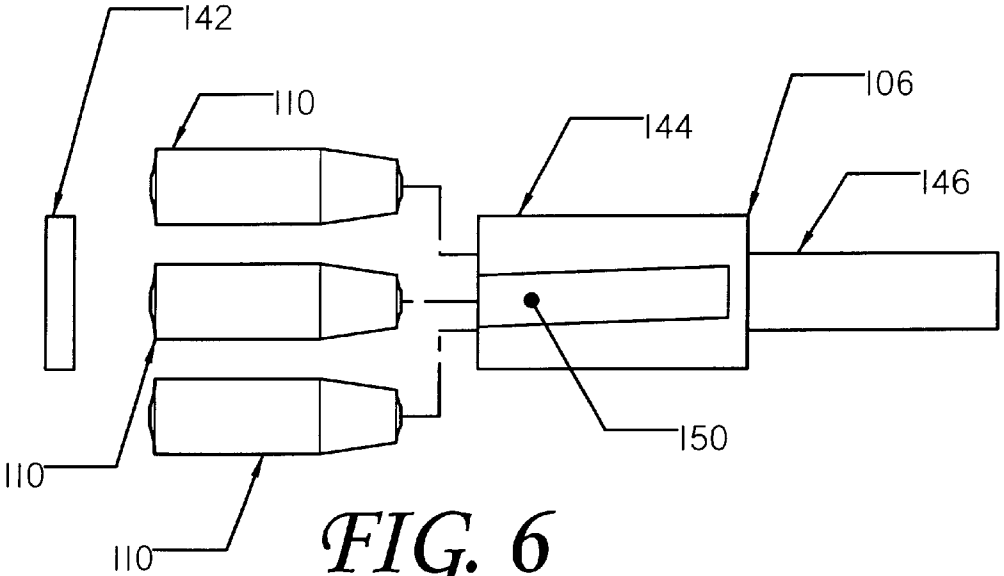
FIG. 6 is an exploded view of the roller cage sub-assembly.

Referring to FIGS. 3, 6 & 7, the structure of the roller cage, 106, can be seen. Primarily, the cage supports and aligns the rollers, 110. It also provides the means to index the location of the roller relative to the conductor. The main body of the cage, 144, defines three chambers, 148, evenly spaced around the longitudinal axis. These chambers are sized to closely receive the rollers. The chambers are angled relative to the longitudinal axis of the roller cage to define the lead angle of the rollers as described above. Openings, 150, allow the rollers to extend slightly beyond the outer surface of the cage and contact the inner wall of the housing. In this manner, the cage provides the alignment of the rollers but does not have to resist the outward radial forces generated by the rollers forming the conductor. This allows the cage to be made from a variety of materials including conventional or low friction plastic, aluminum, sintered bronze, and steel. The end plate, 142, bears the rearward thrust of the rollers and holds them in alignment longitudinally. By indexing the rollers relative to the end plate their position relative to each other and relative to components of the roller cage can be precisely controlled. The end plate is attached to the body of the cage by machine screws or equivalent means. If preferred, the end cap and body can be formed as one piece with the nose removable for insertion of the rollers. The nose, 146, of the cage protrudes forward through the cap and is exposed at the front end of the tool. The nose defines passage, 152, which receives the unmodified conductor. This passage substantially aligns the conductor with the rotational axis of the rollers. The diameter of the nose is reduced relative to that of the cage body to allow it to pass through the cap while the body of the cage is retained. Preferably, the outer diameter of the nose portion is sized to be somewhat smaller than the inner diameter of the outer conductor on the coaxial cable being worked, allowing it to penetrate a short distance within the conductor. The nose acts as a stop to prevent the housing or cap from contacting the outer conductor of the cable while being operated, possibly damaging the conductor. Instead, the nose contacts the dielectric which fills the space between the center conductor and the outer conductor.

One particular set of rollers and roller cage (a cartridge) will reduce a range of original conductor sizes to the same reduced size. The range is from a minimum just larger than the reduced size to a maximum defined by the gap between the roller tips. The tool is designed to allow easy and rapid interchange of cartridges to accommodate different conductor sizes or to form different reduced sizes. The sets are interchanged by removing the cap, extracting the current cartridge, inserting an new cartridge, and replacing the cap. In this manner, the user need only carry a few additional, relatively small, cartridges to adapt the tool to a range of conductor reduction tasks. Where a significant reduction in conductor diameter is to be achieved, an initial reduction operation can be performed, the cartridge exchanged for a smaller size, and the conductor then reduced further by an additional operation. This may be repeated as many times as necessary to achieve the desired final diameter. Optionally, the nose of the cage may be marked, 154, with the reduced size formed by that set of rollers to ease identification by the user of the tool.

Referring again to FIGS. 3 & 4, spring, 158, can be seen. This spring provides consistent forward pressure of the rollers on the conductor resulting in a smooth feed and consistent finish. It also allows the roller cage to move rearward in the housing as the action of the rollers on the inner surface of the housing causes them to move rearward within the chamber. This action of the rollers is discussed in more detail below. After completion of the operation, the spring returns the roller cage to the forward position, ready for a new operation. Other means of applying a forward force on the roller cage, such as a compressed gas bladder or other mechanism, or a hydraulic pressure system, would also be applicable.

Figure 9:
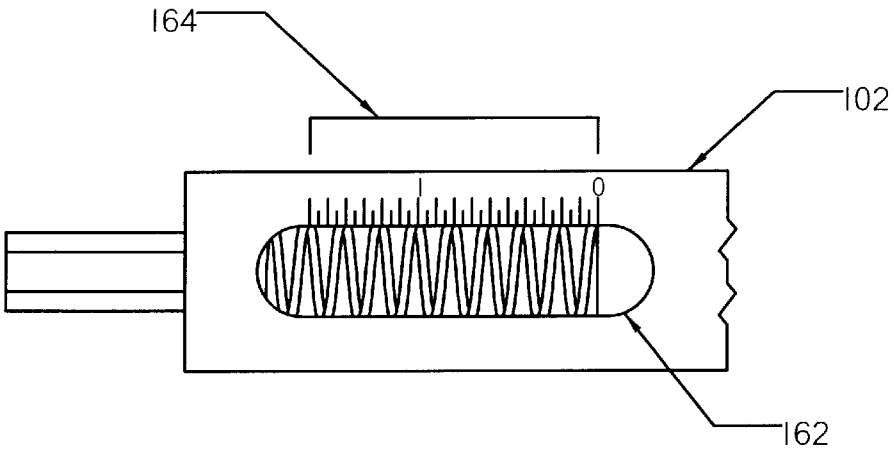
FIG. 9 is a partial side view showing the optional calibration marks.

Indicator sleeve, 160, which is visible through openings 162, provides a visual indication of the distance which the roller cage has moved rearward during operation. Since this distance corresponds directly to the length of conductor which has been reduced, it serves as an indicator of reduced conductor length. This provides an alternative to using the nose of the roller cage, or optional stop collar, as a mechanical stop for the operation. FIG. 9 illustrates an alternative embodiment of the housing wherein calibration marks, 164, are provided adjacent the housing opening in position to align with the edge of the indicator sleeve. Where such visual indication is not desired, the indicator sleeve may be eliminated or replaced with a simple disk or washer.

The cap, 104, can be seen clearly in FIGS. 2–4. It primary purpose is to retain the roller cage, indicator sleeve (where used) and spring within the housing. Opening, 166, allows the nose of the roller cage to extend beyond the cap and allows the cable to pass through as the roller cage retreats rearward in the housing cavity during operation of the tool. See FIGS. 11B & C. Where a stop collar is used, see FIG. 8, the opening is also sized to allow the stop collar to contact the front of the roller cage without interference. While the preferred embodiment utilizes a threaded cap, a more general retaining mechanism is the only requirement. Any mechanism which retains the roller cage within the cavity, against the outward force of the spring is sufficient. This could be a cap retained by other means such as a twist to lock detent; a clip which spans the opening of the housing cavity; a pin inserted through the wall of the housing; an internal split ring or spring clip fitted to a groove in the inner wall of the housing; or any of the other well known means of retaining an element within a cavity.

Figure 8:
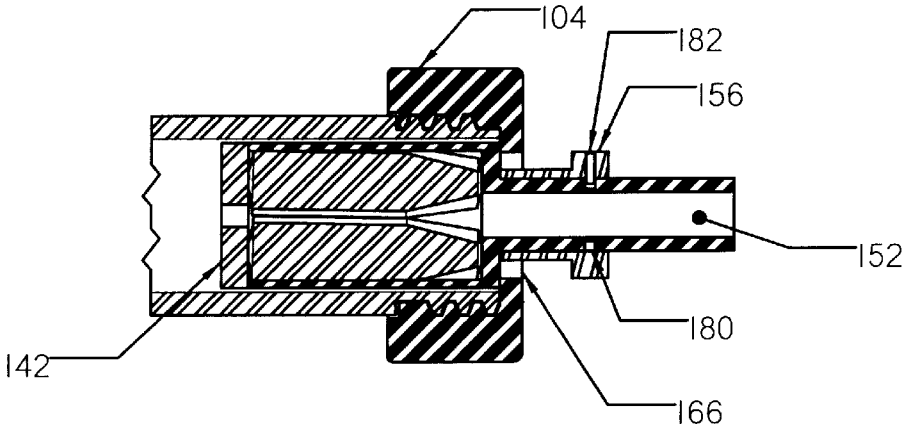
FIG. 8 is a partial cross section illustrating the optional stop collar.

FIG. 8 illustrates an alternative form, which is actually the currently preferred embodiment, of the roller cage, 106, which incorporates a stop collar, 156, attached to the nose, 146, of the cage. This collar acts in a manner similar to the unmodified nose by stopping the forward motion of the tool toward the cable, but contacts the outer conductor rather than the dielectric. By contacting the outer conductor, the stop collar can provide more precise indexing of the roller position on the center conductor relative to the outer conductor. This enables the creation of precise conductor reduction profiles located to within 0.010" relative to the end of the outer conductor. The application of this is discussed in more detail below. Preferably the stop collar is attached to the cage nose in a manner which allows it to freely rotate to minimize the chance of damage to the outer conductor. This attachment can be achieved by a pin, 182, through one side of the collar which is received in a groove, 180, in the nose, the preferred embodiment or by a split ring fitted to a groove in the nose; by providing a shoulder on the stop collar wider than the opening, 166, in the cap which fits into a recess in the cap, allowing it to rotate; or by any other of several means well known in the art. In the preferred embodiment, the stop collar contacts the front face of the roller cage body, providing precise and reliable positioning. Alternatively, a washer could be used which bears against a lip on the cage nose, a ring fitted into a groove on the nose; or any similar mechanism.

A further alternative form of the stop collar would be to fix it to the nose of the roller cage so that it is not free to rotate relative to the cage. The collar would then be rotating when it makes contact with the outer conductor. The front face of the collar could be formed with a profile which would then be transferred to the outer conductor. Potential profiles include inward and outward flares and a rolled edge. These profiles could then be utilized by connectors designed to mate with them, providing an improved physical connection. The stop collar could also be fitted with a blade or cutting edge arranged to trim the end of the outer conductor. This would provide a clean, perpendicular face on the conductor for improved mating.

Operation

Operation of the inventive tool is simple and can be performed by semi-skilled and even unskilled workers. Preparation of the cable is conventional and similar to preparing it for insertion into a connector. The outer insulation and conductor is cut back and the inner dielectric removed to expose a portion of the inner conductor. Additional dielectric is removed from between the inner and outer conductors leaving a recess. A portion of the outer insulator is removed to expose a short length of the outer conductor. Any dielectric adhering to the exposed portion of the inner conductor is removed to leave a clean surface. These steps are well known in the art and can be performed with a variety of tools also well known in the art.

Figure 11A:
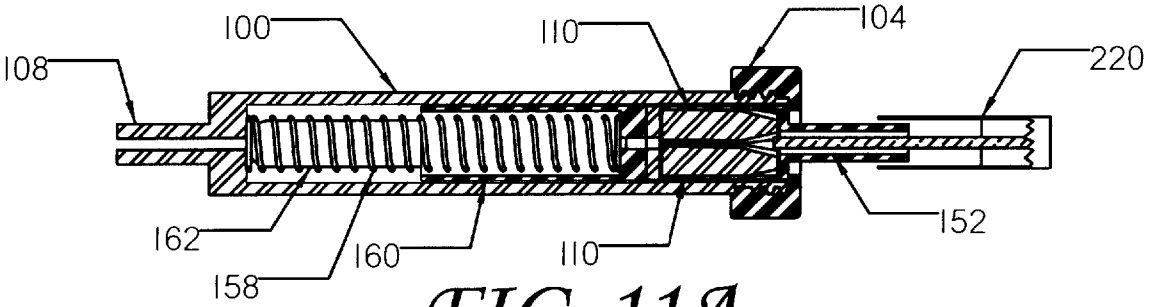
FIGS. 11A–C illustrate the forming of a conductor by the tool.
Figure 11B:
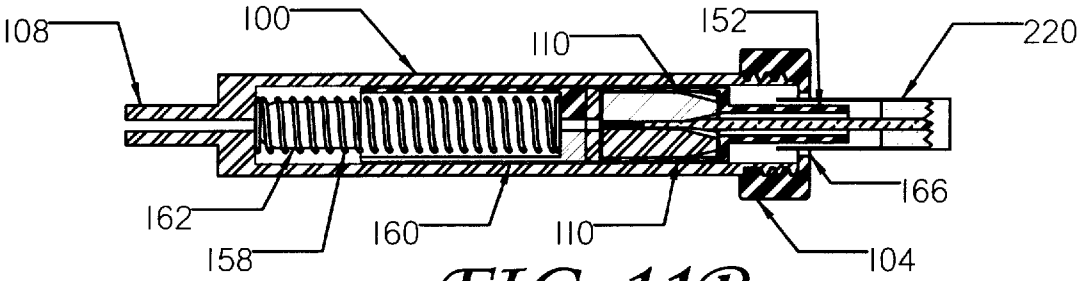
Figure 11C:
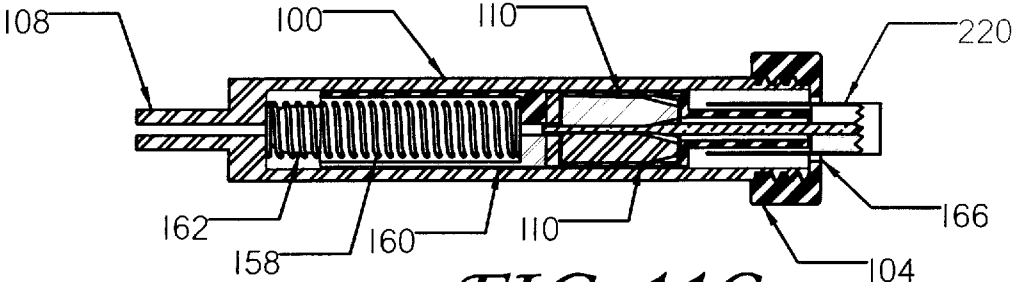

FIGS. 11A–C illustrate the use of the tool. With the cable prepared, the tool, 100 is connected to an electric drill or similar device by gripping the drive shaft, 108, with the drill chuck. (The drill is not shown in the accompanying illustrations for clarity.) The cable, 220, is inserted into the passage, 152, in the nose of the roller cage until the center conductor contacts the rollers, as shown in FIG. 11A. The electric drill is activated at a relatively low speed, causing the tool to rotate. Slight forward pressure will cause the rollers to grip the end of the center conductor. At this point, the rollers are also forced outward against the inner surface of the housing, allowing the rotational drive force to be transmitted from the housing directly to the rollers. When sufficient force is available, the rollers begin roll forming the conductor to a reduced diameter. Because of the lead angle of the rollers, discussed above, the rollers will automatically self feed, traveling in a helical path up the conductor, as long as sufficient forward force is maintained by the user. The spring, 158, assists in maintaining an even forward pressure. With the rollers in contact with the wall of the housing chamber, the lead angle also causes the rollers, and the roller cage, to crawl rearward down the chamber. FIG. 11B illustrates an intermediate point in the forming process. The tip of the conductor has been reduced and the roller cage has started to crawl rearward in the chamber, compressing the spring. The rear edge of the indicator sleeve, 160, is visible through openings, 162, and can be monitored by the user, possibly comparing it to the optional calibration marks adjacent the openings, to determine when to stop. The user can also stop when the nose of the roller cage contacts the dielectric as illustrated in FIG. 11C. This approach provides more precise control of the length of the reduced conductor. Note that the outer conductor passes through the opening, 166, in the cap as the roller cage retreats and that it does not come into contact with the face of the roller cage. As discussed above, an alternative approach would utilize a free rotating stop collar which would contact the outer conductor to serve as a depth stop.

Figure 14:
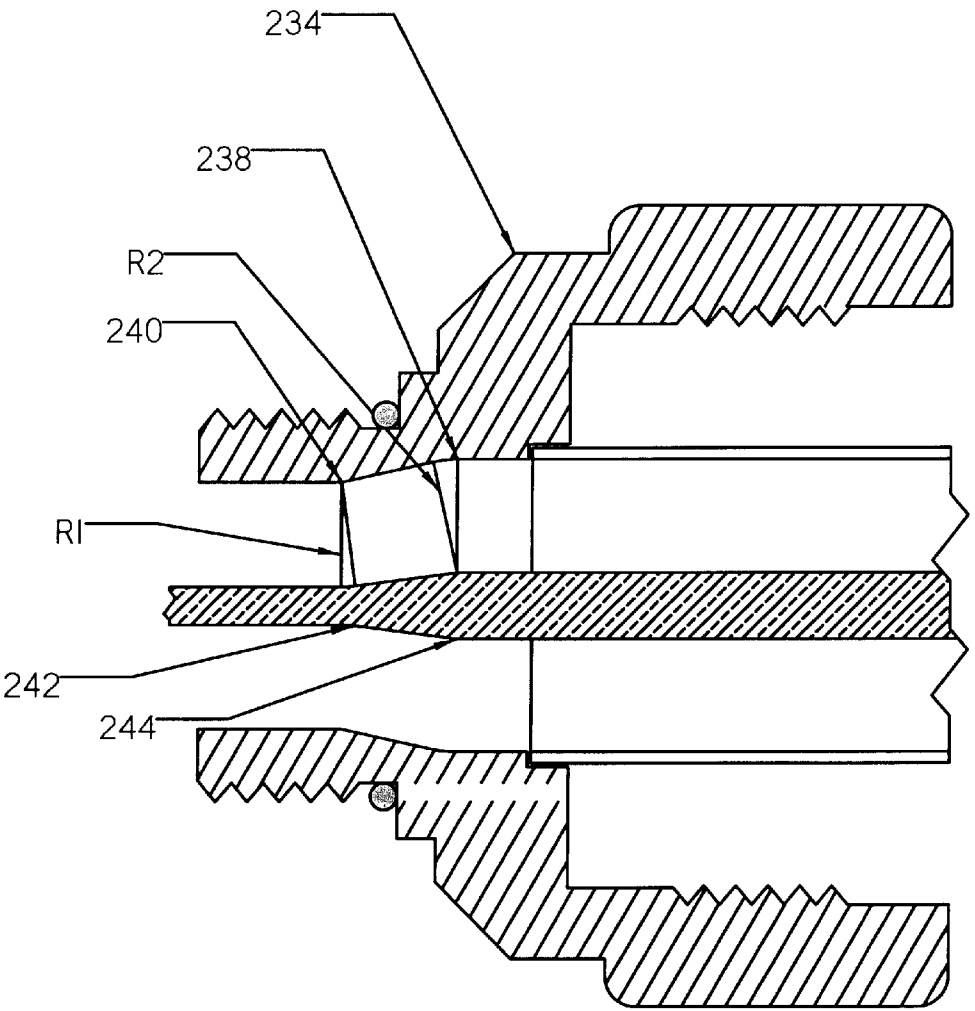
FIG. 14 is a cross section through a novel pass through connector illustrating the alignment of reduction geometries on the conductor and the connector.

The inventive tool has been shown to provide very high accuracy and repeatability with regard to the location of the tapered transition formed in the center conductor and the overall length of the reduced portion of the conductor. Indexing of the shoulder of the transition, relative to the end of the outer conductor is typically +/−0.010". This level of precision enables matching the conductor profile to the inner profile of the connector in a manner not previously practicable. FIG. 13 illustrates a conventional pass through connector, 232, which could be used with the reduced conductor cable created by the inventive tool. The various changes in the diameter of the inner chamber of the connector, and the transition from the outer conductor to the connector chamber all create changes in the impedance of the connection, which in turn creates signal noise. FIG. 14 illustrates a slightly modified connector, 234, in which the transitions in the chamber diameter are precisely aligned with the transitions in the center conductor diameter. In this way, the impedance of the connection can be maintained at a constant level and the associated signal noise eliminated or substantially reduced. A simple approach would be to use steps in the chamber diameter, similar to the connector of FIG. 13, but aligning them with the center conductor transitions. A preferred approach is that illustrated by FIG. 14. Rather than steps, the transitions are smooth. The first transition, 238, is a continuous transition having constant radius, R2, with the beginning of the curve aligned with the shoulder, 244, on the center conductor. The chamber then tapers, maintaining a constant ratio with the diameter of the center conductor as it tapers. This ratio is well known in the art and is specified by the equation [$Z=138\times\log_{10}(I.D./O.D.\times 1/\text{dielectric constant})$]. In a similar manner, the center conductor makes a continuous transition having constant radius, R1, with the end of the curve aligned with the shoulder, 240, on the center connector wall. The connector then continues at constant diameter, concentric with the reduced diameter portion of the center conductor. Because of the precision and repeatability provided by the inventive tool, these transition geometries can be reliably created and aligned by indexing both the tool and the connector relative to the face of the outer conductor. The smooth radius also improves the strength of the conductor. As discussed above, the roller profile illustrated in FIG. 10H incorporates a smooth radius transition from the nose to the body of the roller. One application of this design is to create the above constant radius transition in the center conductor.

While not necessary, the reduced conductor may receive optional treatment steps following the reduction. One option is to precisely trim the length of the conductor by using a tool which indexes from the end of the outer conductor. This would be applicable where a different length than that formed by the inventive tool is desired or where greater precision than that offered by the forming process is needed. Another treatment option is to round over the end of the conductor, eliminating any sharp edges and providing easier insertion into a receptacle. This may be achieved by a rotating die which forms the edge or by using a roller cutter for the above trimming operation which simultaneously shapes the end as it is cutting.

Alternative Embodiments

Several alternative embodiment of the tool, or elements of the tools, exist in addition to those discussed above. FIG. 16 illustrates an alternative embodiment of the cap, 104', which incorporates an extended guard to protect the nose of the roller cage.

FIG. 17 illustrates optional thrust bearing, 170, between the roller cage, 106, and the indicator sleeve, 160, to decrease friction between these two parts. Optional bushing, 172, fits between the front plate of the roller cage and the cap and is of slightly larger diameter than the roller cage. This bushing serves to prevent the body of the roller cage from contacting the walls of the housing. If desired, bearing, 170, can also be oversize and serve in the same manner at the rear of the cage. Alternatively, the rear and front plates of the roller cage can be made with a slightly larger diameter than the body of the cage to also serve this purpose, rather than using separate bushings.

As discussed above with respect to the roller design illustrated in FIGS. 10B and 10I, the roller cage can receive the roller shafts in holes, bushings, or bearings. FIGS. 18 & 19 illustrate an alternative embodiment of the rear plate adapted to serve this purpose. In addition to the holes, 176, for the shafts, this view also shows the holes and counter bores, 174, for the attaching screws. The front plate can also be drilled to receive the shafts in a similar manner. The rear plate has also been formed with a center crown to reduce the friction resulting from contact with the front face of the indicator sleeve. This crown may also be used without the shaft holes. In the preferred embodiment, the crown is approximately 3 degrees.

A further alternative is to support the rollers fully by shafts supported by the roller cage. The rollers would not contact the inner wall of the housing but would be driven directly by the roller cage. This would require a drive connection between the housing and the roller cage to transmit the rotary driving force. A simple solution would be to use a non-circular cross section for the chamber (such as hexagonal) and a matching shape for the roller cage. This connection could also use a key, splines, cams, or any of various mechanisms well known in the art in combination with any type of cross section including circular. This would eliminate the characteristic of the roller cage crawling down the housing cavity, allowing a shorter housing to be used, but would require a significantly stronger roller cage to resist the axial loads on the rollers. The spring would still operate to provide an even forward force on the roller cage for smooth engagement of the conductor.

Figure 20:
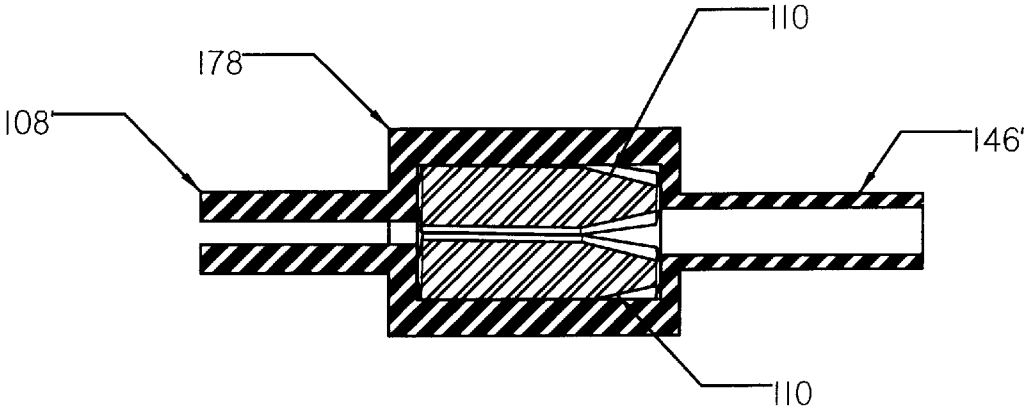
FIG. 20 is a cross section through an alternative form of the tool in which the roller cage is driven directly.
Figure 21:
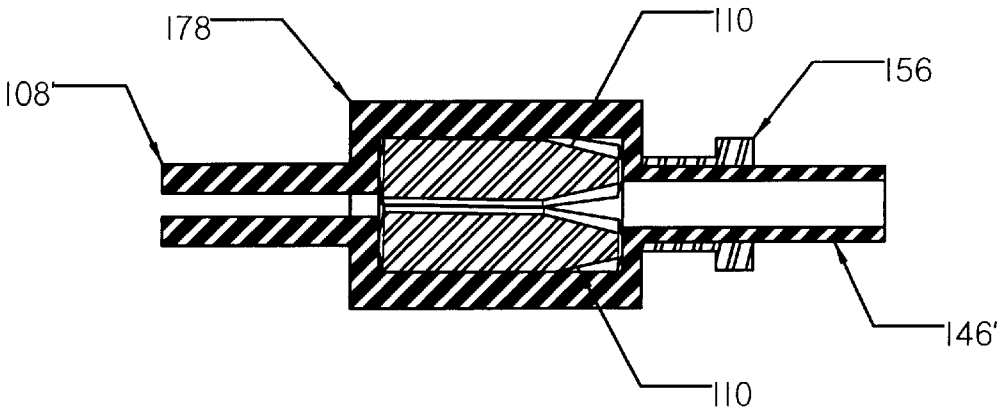
FIG. 21 is a cross section through the alternative form of FIG. 21 illustrating an optional stop collar.

A yet further alternative, FIG. 20, would be to eliminate the housing, spring, and cap completely, and drive the roller cage, 178, directly from the electric drill, via a drive shaft, 108', connected directly to the cage. This results in a much simpler design, but without many of the advantages of the preferred embodiment. The roller cage would have to be significantly stronger and thus more expensive. While different tools could be used for different conductor diameters, the simple, low cost alternative of interchanging cartridges is lost and the individual tools would be more expensive than the cartridges. This design could also incorporate a stop collar, 156, as shown in FIG. 21.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. Where it is desired to reduce the diameter of a portion of the center conductor of a coaxial cable having center and outer conductors and an intervening dielectric, a reducing tool comprising:

(a) a roller cage having a rotational axis;

(b) plural rollers each having a body portion and a tapered nose portion, said rollers retained within said roller cage;

(c) a housing defining an internal chamber adapted to closely receive said roller cage, said chamber having an open end;

(d) a retaining mechanism to retain said roller cage within said chamber;

(e) a mechanism to urge said roller cage toward said open end; and (f) a drive connection adapted to connect said housing to an external rotary drive source.

2. The reducing tool of claim 1 wherein said rollers are retained by said roller cage at a lead angle in the range of ½ to 5 degrees relative to said rotational axis.

3. The reducing tool of claim 1 wherein said rollers further comprise a transition portion joining said body portion and said nose portion, said transition portion defining a continuous curve.

4. The reducing tool of claim 1 wherein said roller body portion does not bear against the conductor during normal operation.

5. The reducing tool of claim 1 wherein said body portion and said nose portion of said rollers are rotationally connected but are free to rotate at separate rates.

6. The reducing tool of claim 1 further comprising a depth stop rotatably connected to said roller cage, adapted to contact a portion of the coaxial cable other than the center conductor.

7. The reducing tool of claim 1 wherein said roller cage supports said rollers out of contact with said housing and further comprising a sliding connection between said roller cage and said housing whereby rotary motion of said housing is transmitted to said roller cage but longitudinal movement of said roller cage within said chamber is unrestricted by said connection.

8. The reducing tool of claim 1 wherein said roller cage rotates freely within said chamber and said rollers are adapted to contact the walls of said chamber whereby rotary motion of said housing is transmitted directly from said housing to said rollers.

9. Where it is desired to reduce the diameter of a portion of the center conductor of a coaxial cable having center and outer conductors and an intervening dielectric, a reducing tool comprising:

(a) a housing defining an internal chamber of substantially circular cross section, said chamber having an open end;

(b) a roller cage, having a rotational axis, comprising:

(i) a body with first and second ends; and (ii) a nose extending from said first end, defining a central passage coaxial with said rotational axis adapted to receive the center conductor, said nose at least somewhat narrower than said body;

said roller cage removably received within said chamber;

(c) plural rollers each having a tapered nose portion and an immediately adjacent body portion with a base end opposite said nose portion, said rollers retained within said roller cage at a defined lead angle relative to said rotational axis;

(d) means for urging said roller cage toward said open end of said chamber;

(e) means for releasably retaining said roller cage within said chamber; and (f) means for removably connecting a source of rotational force to said housing.

10. The reducing tool of claim 9 wherein said lead angle is in the range of 1 to 2 degrees.

11. The reducing tool of claim 9 wherein each of said rollers has a maximum diameter and at least a portion of each of said roller bodies has a diameter less than said maximum diameter.

12. The reducing tool of claim 11 wherein each of said roller bodies tapers from a maximum diameter adjacent said nose portion to a lesser diameter at said base end.

13. The reducing tool of claim 9 wherein each of said rollers further comprises a coaxial supporting shaft having two outwardly extending ends and wherein said roller cage further comprises sockets adapted to receive said shaft ends.

14. The reducing tool of claim 13 wherein said rollers are retained in said roller cage with said shaft at said base end at a greater radial distance from said rotational axis than said shaft at said nose end.

15. The reducing tool of claim 9 wherein said body portion and said nose portion of said rollers are rotationally connected but are free to rotate at separate rates.

16. The reducing tool of claim 9 wherein said rollers further comprise a transition portion joining said body portion and said nose portion, said transition portion defining a continuous curve.

17. The reducing tool of claim 9 wherein said roller cage further comprises a front bushing and a rear bushing, each of said bushings of slightly greater diameter than said body.

18. The reducing tool of claim 9 wherein said roller cage nose has an outer diameter less than the inner diameter of the coaxial cable outer conductor.

19. The reducing tool of claim 9 further comprising a depth stop rotatably engaged on said roller cage nose, coaxial to said rotational axis, said depth gage adapted to contact the outer conductor of the coaxial cable.

20. The reducing tool of claim 9 wherein said housing further defines at least one opening through the wall of said chamber and further comprising an indicator within said chamber adapted to move longitudinally in fixed relation to said roller cage whereby said indicator can be viewed through said opening.

21. The reducing tool of claim 20 further comprising calibration marks fixed to said housing adjacent said opening for comparison to the position of said indicator.

22. The reducing tool of claim 9 further comprising a guard fixed to said housing and at least partially enclosing said roller cage nose.

* * * * *